US005561880A

United States Patent [19]

Allen et al.

[11] Patent Number: 5,561,880

[45] Date of Patent: Oct. 8, 1996

[54] STEAM CABINET AND STEAMING METHOD

[75] Inventors: Kenneth R. Allen; T. Christopher Carlin; Kenneth S. Allen, all of Council Grove, Kans.

[73] Assignee: A/C Enterprises, Inc., Council Grove, Kans.

[21] Appl. No.: 338,683

[22] Filed: Nov. 14, 1994

[51] Int. Cl.[6] ..... D06B 23/20

[52] U.S. Cl. ..... 8/149.3; 68/5 C; 68/6; 223/51; 223/70

[58] Field of Search ..... 8/149.3; 223/51, 223/70; 68/6, 5 C

[56] References Cited

U.S. PATENT DOCUMENTS

| | | | |
|---|---|---|---|
| 2,048,749 | 7/1936 | Lydon | 68/5 C X |
| 2,572,893 | 10/1951 | Richter | 223/51 |
| 2,703,973 | 3/1955 | Fawcett | 68/6 |
| 3,707,855 | 1/1973 | Buckley | 68/6 |
| 5,094,020 | 3/1992 | Wingfield et al. | 223/51 |
| 5,305,484 | 4/1994 | Fitzpatrick et al. | 68/5 C |
| 5,349,767 | 9/1994 | Foo . | |
| 5,376,144 | 12/1994 | McClain et al. | 68/5 C |

*Primary Examiner*—Frankie L. Stinson

*Attorney, Agent, or Firm*—Litman, McMahon and Brown, L.L.C.

[57] ABSTRACT

A steam cabinet includes a base assembly with a water pan and an electrical resistance heater subassembly mounted in thermally conductive relationship therewith. The water pan includes a water inlet and a water outlet. A cabinet assembly is mounted on the base assembly and includes front, back and opposite side walls. A roof structure is mounted on top of the side walls. The cabinet assembly front wall includes an opening which receives a door for providing access to the cabinet interior. The cabinet body side walls include receivers for mounting hanging rods extending therebetween and adapted for supporting multiple garments on hangers. A control system includes multiple float switches in the water pan which are activated by various water level conditions in the water pan. A microprocessor is provided for controlling the heater and water supply operation and timing the steam cabinet operation. A method of steaming garments includes the steps of providing a water pan; filling the water pan to a predetermined level; energizing heaters connected to the water pan in a heat-exchange therewith; providing a cabinet assembly mounted on a base including the water pan and the heater; placing a horizontal rod in said cabinet over said water pan; hanging a garment from said rod; de-energizing said heater after a predetermined time period; and maintaining the temperature of the water in the water pan at a predetermined preheat temperature.

23 Claims, 8 Drawing Sheets

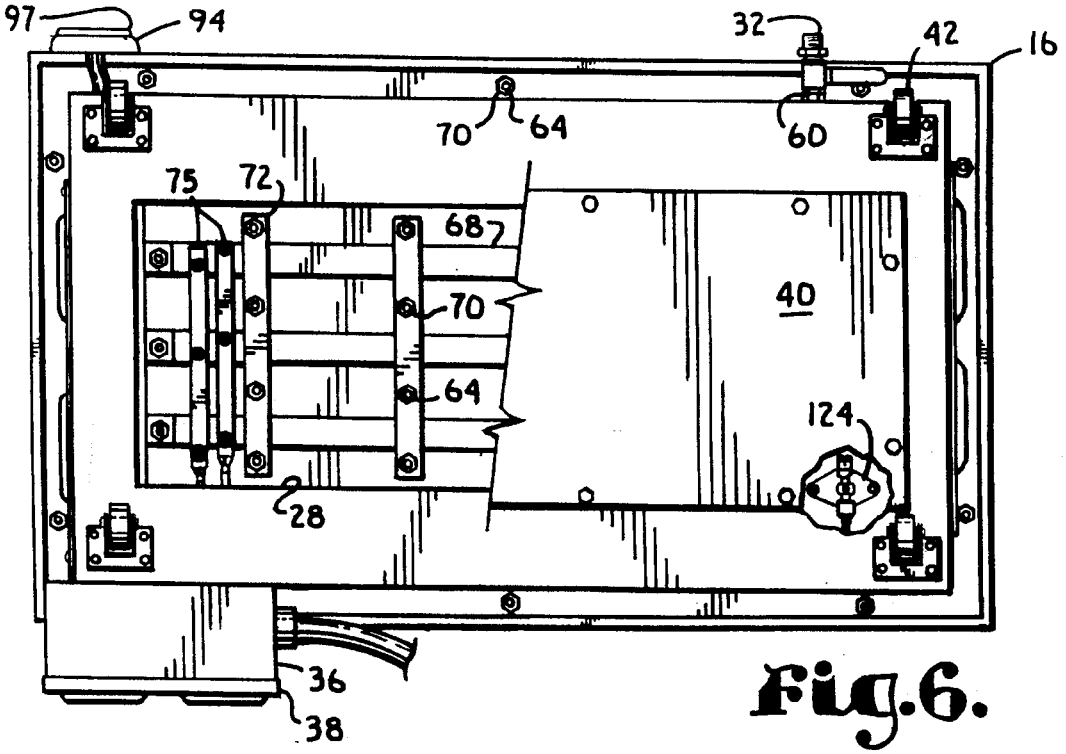
Fig.6.
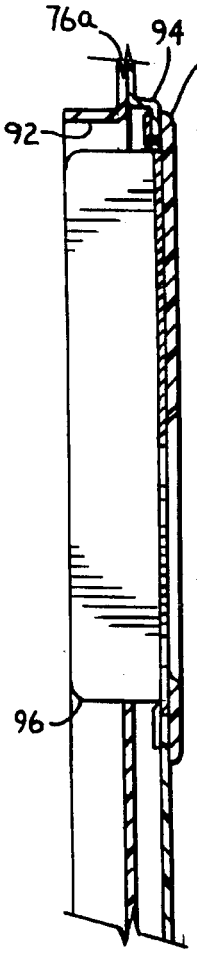
Fig.7.
Fig. 7 a.
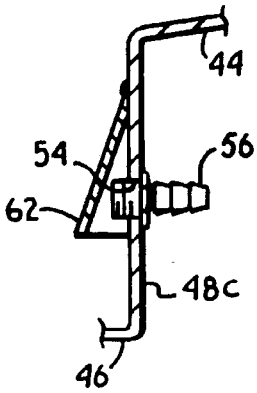

STEAM CABINET AND STEAMING METHOD

BACKGROUND OF THE INVENTION

1. Field of the Invention

The present invention relates generally to steam cabinets, and in particular to a steam cabinet for removing wrinkles from garments and including an automatic control system.

2. Description of the Related Art

Steam cabinets and other steam producing devices have previously been developed for meeting the requirements of various applications. For example, steam is frequently used to relax the fibers of various fabrics for removing wrinkles. Equipment for ironing and pressing clothing therefore often includes means for subjecting the garments to steam.

Aesthetic considerations are generally very important in merchandising garments. The appearance of the garments being offered for sale tends to be relatively important at all levels of the respective trade channels from manufacturers and wholesalers to retailers and consumers. Excessive wrinkles and creases can significantly detract from the appearance of a garment. Hence, retailers will often invest significant amounts of time in pressing and ironing clothing prior to putting it on display.

Fabrics such as polyesters tend to resist wrinkling, but cotton fabrics are generally very susceptible to wrinkling. Nevertheless, cotton is one of the most popular, if not the most popular, of all the fabrics used for wearing apparel.

A common and widespread problem for clothing retailers relates to removing wrinkles from garments for display purposes. Many clothing retailers display large portions of their inventories for inspection and fitting by potential customers. However, the garments are often shipped to the retailers under conditions which can exacerbate problems with wrinkling and creasing. Cotton garments in particular, but also many other types of garments, are susceptible to wrinkling and creasing during shipment, particularly if they are tightly packed in shipping containers and the like. Wrinkles and creases which are present upon receipt often remain even after the garments are suspended on display racks. However, displaying garments in wrinkled condition tends to detract from their appearance and can depress sales.

Previous solutions to this problem included ironing and pressing such garments by hand and applying steam thereto with hand steamers and the like. Another previous solution to the problem of wrinkled garments was to place them in a commercial steam cabinet. Such cabinets often required external steam sources, and tended to be relatively expensive.

Treating garments individually tends to be prohibitively time consuming in retail establishments that deal in large volumes, particularly since the employees of such establishments are generally not available for pressing and steaming individual garments. Moreover, the results achieved by such methods tended to be relatively inconsistent and varied among different individuals who were responsible for pressing, ironing and steaming garments by hand.

In addition to the expense of previous commercial steam cabinets, other disadvantages thereof included expense, maintenance and operating complexity. Moreover, safety is an important consideration with steam cabinets since they involve combining heat and water sources in the production of steam and the treatment of garments. Potential hazards from fire, electrical shock and water damage must be addressed in order to provide a safe and effective system.

SUMMARY OF THE INVENTION

In the practice of the present invention, a steam cabinet is provided for steaming garments on hangers within a cabinet interior. A base assembly is provided which includes a water pan and a heater subassembly. The heater subassembly includes a plurality of electrical resistance heaters mounted on the water pan. A cabinet assembly includes sidewalls with hanging rod pockets for receiving the ends of a hanging rod extending across the cabinet assembly interior. Garments on hangers can be suspended from one or more hanging rods in the cabinet interior. The cabinet assembly also includes a back wall and a front wall with a door opening receiving a door which is slidably movable between open and closed positions. A roof is mounted on top of the walls, which are mounted on top of the base assembly. The roof has sloping surfaces for returning water to the water pan. A plumbing subsystem includes a solenoid-activated shut-off valve for providing water to the water pan and a manual shut-off valve for draining the unit. A control system includes water level float switches mounted in the water pan, a temperature sensor and a control panel mounted on the cabinet assembly front wall. A programmable microprocessor controls the operation of the steam cabinet, including the timing of various functions and operational modes thereof. In the practice of the method of the present invention, a steam cabinet is provided which includes a base having a water pan with heaters mounted thereon and a cabinet assembly. A control system is provided which controls an initialization procedure whereby the water level in the water pan is verified and the water is brought to a predetermined preheat temperature. A steam cycle is initiated and has a duration which can be adjusted by the operator. At the conclusion of the steam cycle, a cool down cycle is initiated, whereafter the completion of a steaming operation is signaled. The steaming method also includes the steps of providing a software interrupt module for turning off the heaters in response to a low water condition.

OBJECTS AND ADVANTAGES OF THE INVENTION

The principle objects and advantages of the invention include: providing a steam cabinet; providing such a steam cabinet for steaming garments and the like; providing such a steam cabinet with an automatic control system; providing such a steam cabinet with a water supply system for automatically filling same; providing such a steam cabinet with water level sensors for protecting the steam cabinet against overflow and insufficient water conditions; providing such a steam cabinet with a programmable control system; providing such a steam cabinet which can be set for steam operations of various durations; providing such a steam cabinet which can accommodate a number of garments for batch steam processing thereof; providing such a steam cabinet with overheat shut-off protection; providing such a steam cabinet with a pre-heat mode of operation wherein the water temperature is elevated; providing such a steam cabinet which does not require an external steam source; providing such a steam cabinet which is adapted for operation on electrical power; providing such a steam cabinet which includes an automatic water level control system; providing such a steam cabinet which can be adapted for operation in retail clothing stores; providing such a steam cabinet which can significantly improve the appearance of garments treated therein by removing wrinkles therefrom; providing such a steam cabinet which is efficient in operation, economical to manufacture, relatively simple to use, relatively automatic in operation, and which is particularly well adapted for the proposed usage thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 6 is a bottom plan view of the steam cabinet, with portions thereof broken away to reveal internal construction.

FIG. 7 is a vertical, cross-sectional view taken generally along line 7—7 in FIG. 1 and particularly showing the construction of a control panel mounting subassembly.

FIG. 7*a* is an enlarged, fragmentary, cross-sectional view taken generally along line 7*a*–7*a* in FIG. 5 and particularly showing a water inlet shield.

DETAILED DESCRIPTION OF THE PREFERRED EMBODIMENTS

I. Introduction and Environment

Figure 1:
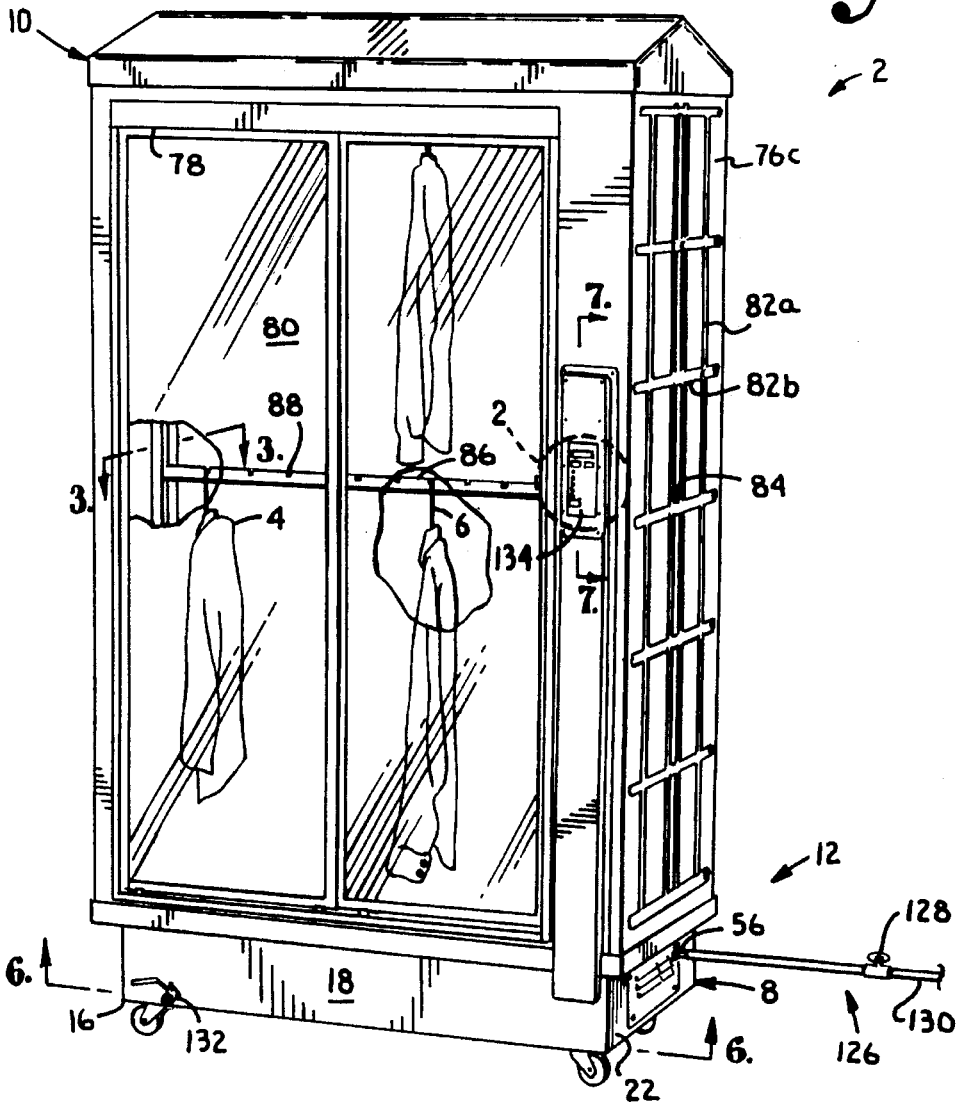
FIG. 1 is a front perspective view of a steam cabinet embodying the present invention, shown with garments hung therein.
Figure 2:
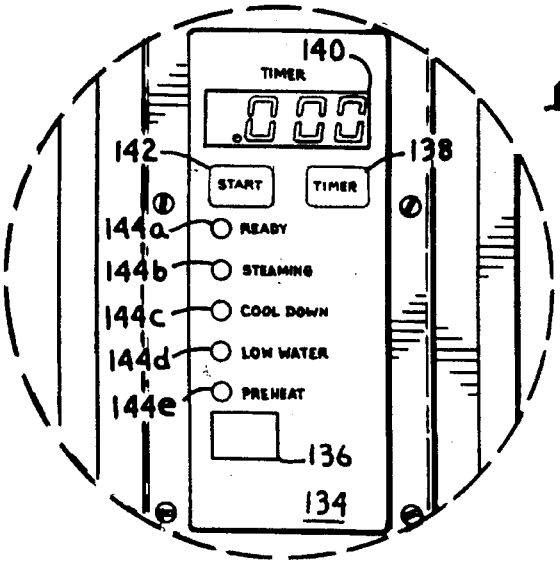
FIG. 2 is an enlarged, fragmentary, front elevational view particularly showing a control panel thereof, generally showing the area within circle 2 in FIG. 1.
Figure 3:
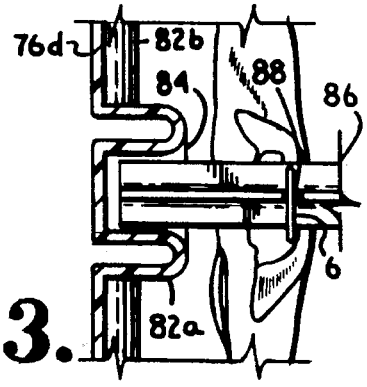
FIG. 3 is an enlarged, fragmentary, top plan view of a hanging rod with a garment suspended therefrom, taken generally along line 3—3 in FIG. 1.
Figure 4:
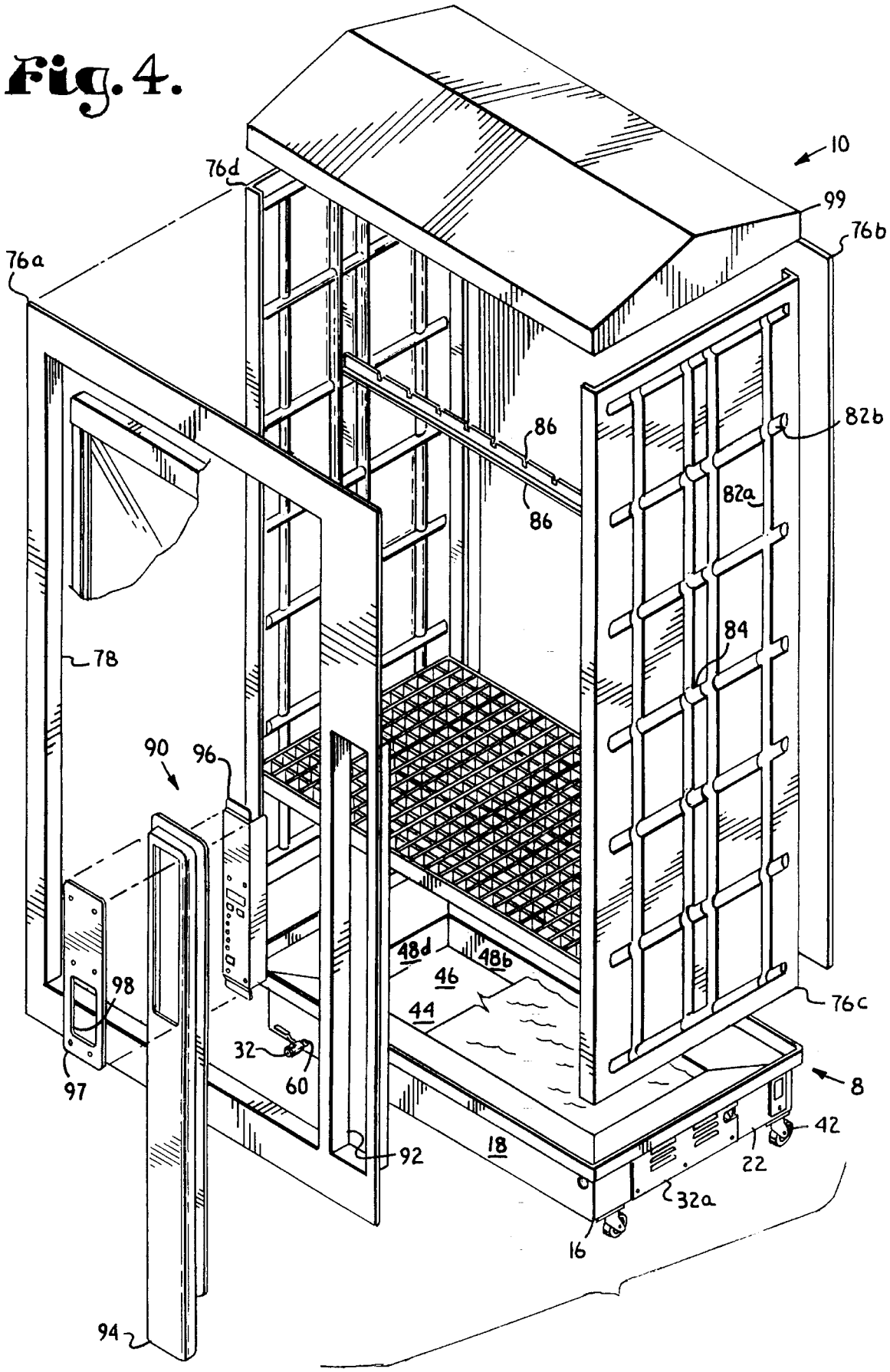
FIG. 4 is an upper, front, right side exploded perspective view of the steam cabinet.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Certain terminology will be used in the following description for convenience in reference only and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the embodiment being described and designated parts thereof. Said terminology will include the words specifically mentioned, derivatives thereof and words of a similar import.

Referring to the drawings in more detail, the reference numeral 2 generally designates a steam cabinet for garments 4 and the like, which can be placed therein on hangers 6. The steam cabinet 2 generally comprises a base assembly 8, a cabinet assembly 10, a plumbing or water supply subsystem 12 and a control system 14.

II. Base Assembly.

Figure 5:
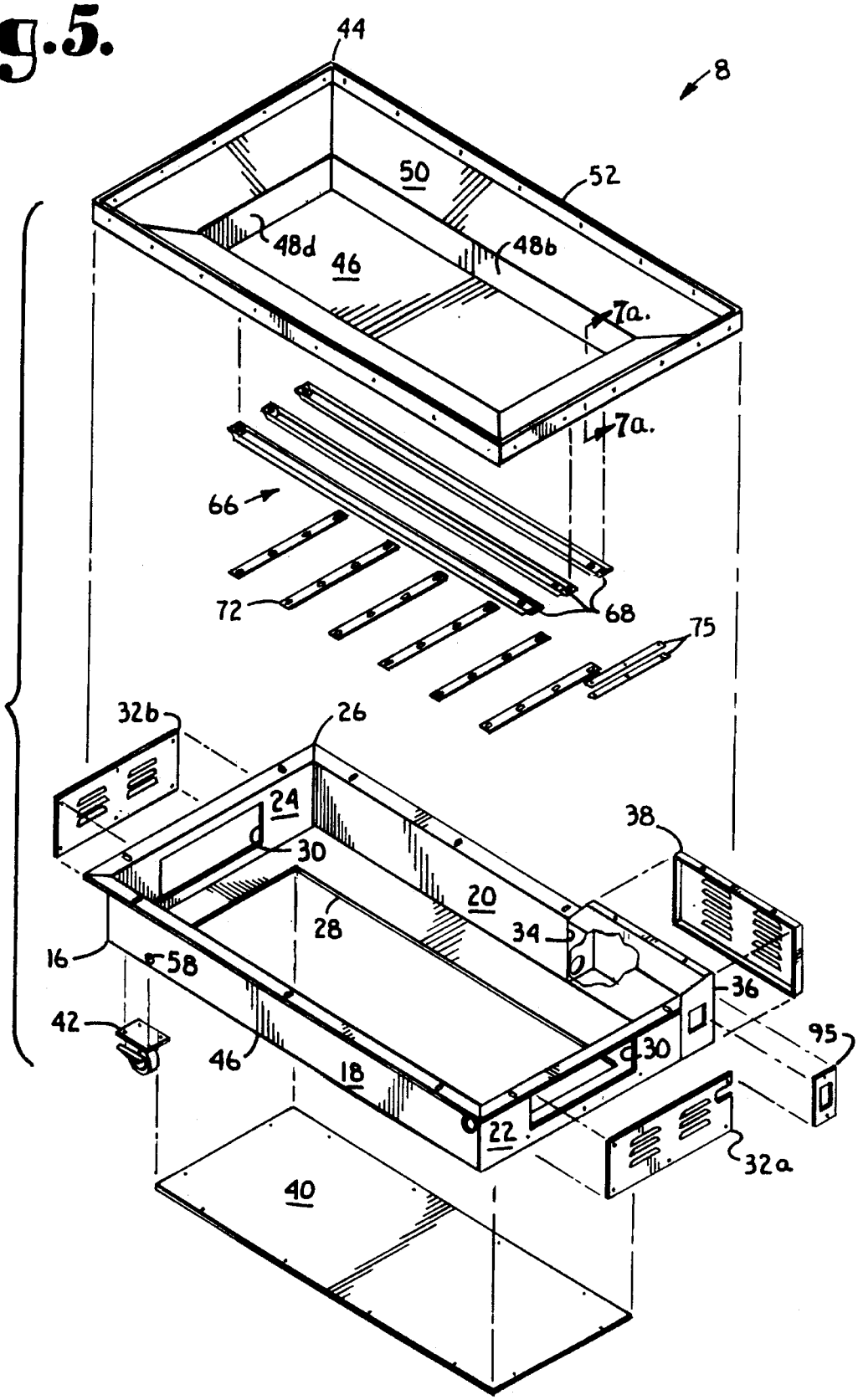
FIG. 5 is an upper, front, right side exploded perspective view of a base assembly of the steam cabinet.

The base assembly 8 (FIG. 5) includes a generally rectangular base frame 16 with a front 18, a back 20, a first or right side 22 and a second or left side 24. Upper and lower flanges 26, 28 extend outwardly and inwardly respectively from the base frame front 18, back 20 and sides 22, 24. Each base frame side 22, 24 includes an opening 30 and mounts a respective vented cover plate 32*a*, b covering same. The base frame back 20 includes an electrical box opening 34 mounting an electrical box 36, which in turn mounts a vented back cover 38.

A bottom cover plate 40 can be mounted on the lower flange 28. The lower flange 28 is also adapted for mounting casters 42, which can be equipped with suitable brake mechanisms for fixedly positioning the steam cabinet 2. The upper flange 26 can slope slightly inwardly and downwardly.

A water pan 44 includes a bottom 46, front, back, first/right side and second/left side walls 48*a*, 48*b*, 48*c*, and 48*d* respectively forming a generally rectangular configuration. A drip flange 50 extends generally outwardly and slopes slightly upwardly away from the pan walls 48 *a–d* and terminates at an upwardly-extending lip 52.

A water inlet opening 54 in the right pan wall 48*c* mounts an inlet nipple 56 and an outlet opening 58 in the front pan wall 48*a* mounts an outlet nipple 60. The nipples 56 and 60 can be suitably threaded. A tapered, wedge-shaped water shield 62 is mounted over the inlet opening 54 on the inside face of the right pan wall 48*a*. Multiple weld studs 64 depend downwardly from the pan bottom 46 in a grid pattern (e.g. 4×5) and from spaced locations around the drip flange 50. The water pan 44 is mounted on the base frame 16 by nuts received on respective weld studs 64.

The base assembly 8 includes a heater sub-assembly 66 having a plurality (e.g., 3 are shown) of heating element channels 68 which are secured at their ends to the pan bottom 46 by nuts 70 which are received on respective weld studs 64. Heater straps 72 are likewise bolted on the water pan bottom 46 for clamping the channel 68 thereto intermediate their respective ends and are secured by nuts 70 on respective weld studs 64. Each channel 68 receives a suitable electrical resistance heating element 74, which can comprise nichrome wire or a similar suitable heat source means. Bus bars 75 are connected to the heating elements 74 and the power system.

III. Cabinet Assembly

The cabinet assembly 10 includes front, back, first/right side and second/left side walls 76*a*, 76*b*, 76*c* and 76*d* respectively. The front wall 76*a* includes a door opening 78 mounting a sliding, transparent (e.g. glass or plexiglass) door 80 for selectively closing same. A roof 99 is mounted on top of the walls 76*a–c*.

Each side wall 76*c*, 76*d* includes a grid pattern formed by respective vertical and horizontal inwardly-projecting ridges 82*a*, 82*b*. A plurality of hanging rod pockets 84 are formed by the ridges 82*a*, 82*b* and are located in vertically-spaced relation generally along vertical center lines of the cabinet side walls 76*c*, 76*d*. The hanging rod pockets 84 receive respective ends of a hanging rod 86, which can have an inverted T-shaped cross section with multiple, spaced notches 88 for receiving hangers 6. The steam cabinet 2 can be used with one or more hanging rods 86. For example, one hanging rod 86 can be mounted in the uppermost opposed pair of notches 88 for relatively long garments. A second hanging rod 86 can be mounted in an opposed pair of notches 88 approximately halfway down the cabinet side walls 76*c*, 76*d* for simultaneously steaming a second set of garments, such as shirts, skirts or the like.

A control panel mounting sub-assembly 90 is mounted on the front wall 76*a* adjacent to the door opening 78 in general covering relation over a flanged, elongated control wiring opening 92 formed in the front wall 76*a* between the right sidewall 76*c* thereof and the door opening 78. The control panel sub-assembly 90 includes a control wiring cover 94 mounted on the cabinet front wall 76*a* generally in covering relation over the control wiring opening 92 and depending slightly downwardly from a lower edge of the cabinet assembly 10 to cover wiring runs between the control system 14 and the base assembly 8. A control panel bracket is mounted in the control wiring cover 94 and is in turn covered by and mounts an upper control faceplate 97 with a faceplate opening 98.

IV. Control System 14

The control system 14 includes a microprocessor or micro-controller 102 which is connected to or incorporates a timer 103. Without limitation on the generality of useful programmable microprocessors, an Intel 8749 microprocessor with 4 k memory and 3 I/O ports can be utilized.

Figure 8:
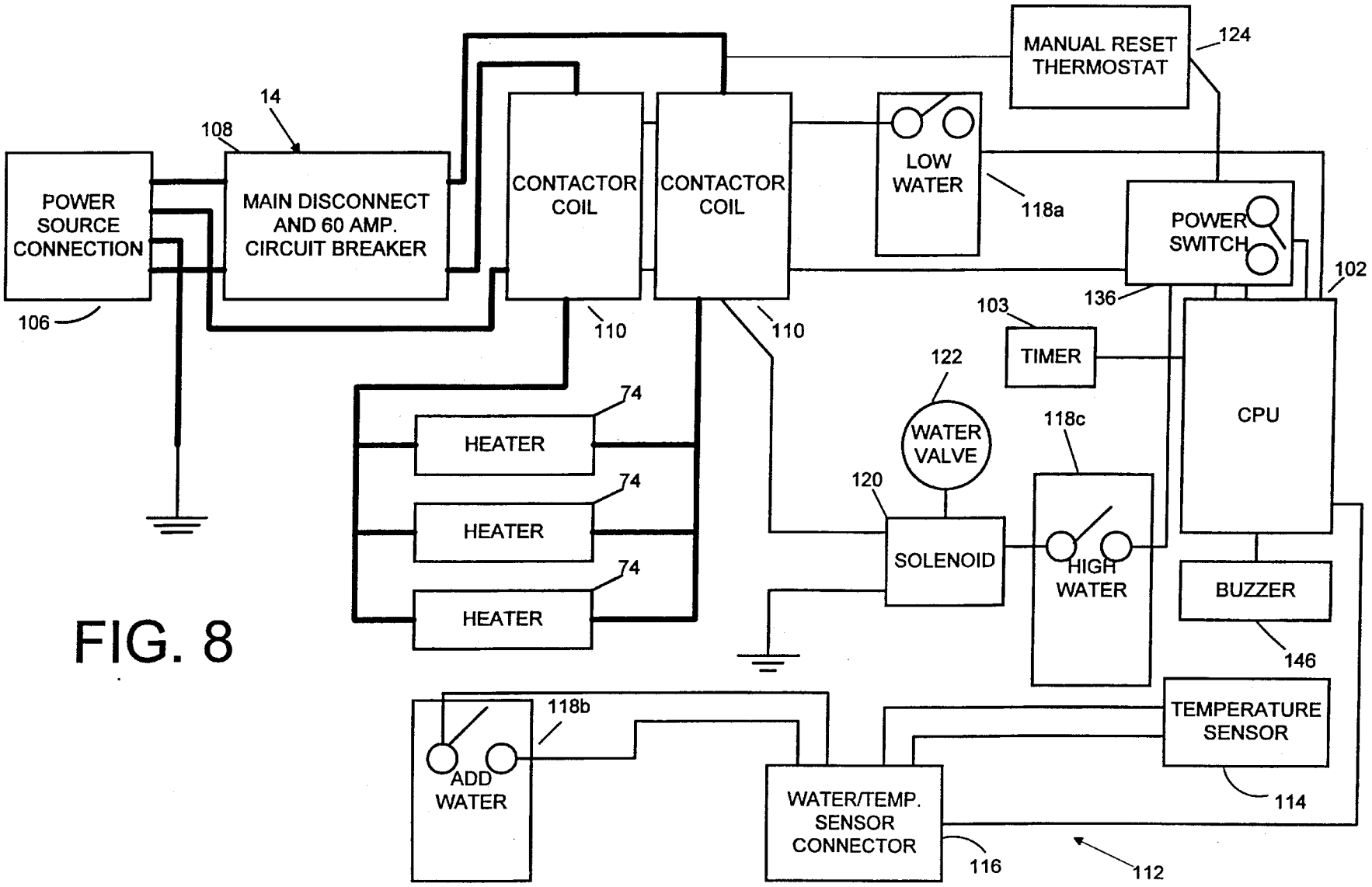
FIG. 8 is an electrical schematic thereof.

A schematic diagram of the control system 14 is shown in FIG. 8 and includes a power supply subsystem 104 having a plug or other suitable connection means 106 for connection to a suitable power source through a combined circuit breaker (e.g. 60A) and main power disconnect switch 108 which is mounted on the base frame 16 by a switch cover 95. The steam cabinet 2 is designed for operation with 220 or 208 volts AC, single phase current drawing about 45 amps or three phase current drawing about 26 amps and consuming about 9,000 watts of power. The electrical power supply is designed to meet the requirements of particular applications of the steam cabinet 2 and can vary accordingly. Contactor coils 110 selectively connect the heaters 72 with the electrical power.

A water temperature control subsystem 112 includes a temperature sensor 114 mounted in the water pan 44 and connected to a water/temperature sensor connector 116. The water/temperature sensor connector 116 is connected to the microprocessor 102. The water pan 44 mounts low water, add water and high water float switches 118*a*, 118*b*, 118*c*. The low water float switch 118*a* is connected to the contactors for de-energizing the heaters 72 in the event the water level in the water pan 44 drops below a minimum level required for safe operation. The add water switch 118*b* goes through the microprocessor 102 to the water/temperature sensor connector 116 and causes a water valve solenoid 120 to open a water valve 122 in response to a water level in the water pan 44 dropping to a level requiring the addition of water. The high water float switch 118*c* is connected in series with the solenoid 120 and closes the water valve 122 in response to a high water or full condition of the water pan 44.

A safety overheat thermostat 124 is provided for de-energizing the heaters 72 in response to an overheated condition and is manually resettable. The overheat thermostat 124 provides a safety feature by cutting power to the contactor coils 110, which cuts power to the heaters 72 in the event of a system failure to reduce the risk of fire or other damage to the steam cabinet 2 and its surroundings.

A plumbing subsystem 126 includes the solenoid-actuated water valve 122. A shut-off water valve 128 is mounted in a water line 130 for controlling water supply to the water valve 122, and can be provided separately from the steam cabinet 2, e.g., by a plumber or other installer. As an alternative to providing a continuous water supply, the steam cabinet 2 can be provided with a water reservoir for refilling the water pan 44. The water line 130 is preferably coiled to allow a certain range of motion for the steam cabinet 2 by uncoiling the water line 130. A petcock drain valve 132 is mounted on the outlet nipple 60 for draining the water pan 44.

A control panel 134 includes an on/off power switch 136, a timer switch 138 for setting the steam cycle time, an LED display 140 for indicating the preset steam cycle time, a start switch 142 for initiating the steam cycle and indicator lights 144*a–e* for indicating ready, steaming, cool down, low water and pre-heat conditions respectively.

V. Operation and Garment Steaming Method.

Figure 9:
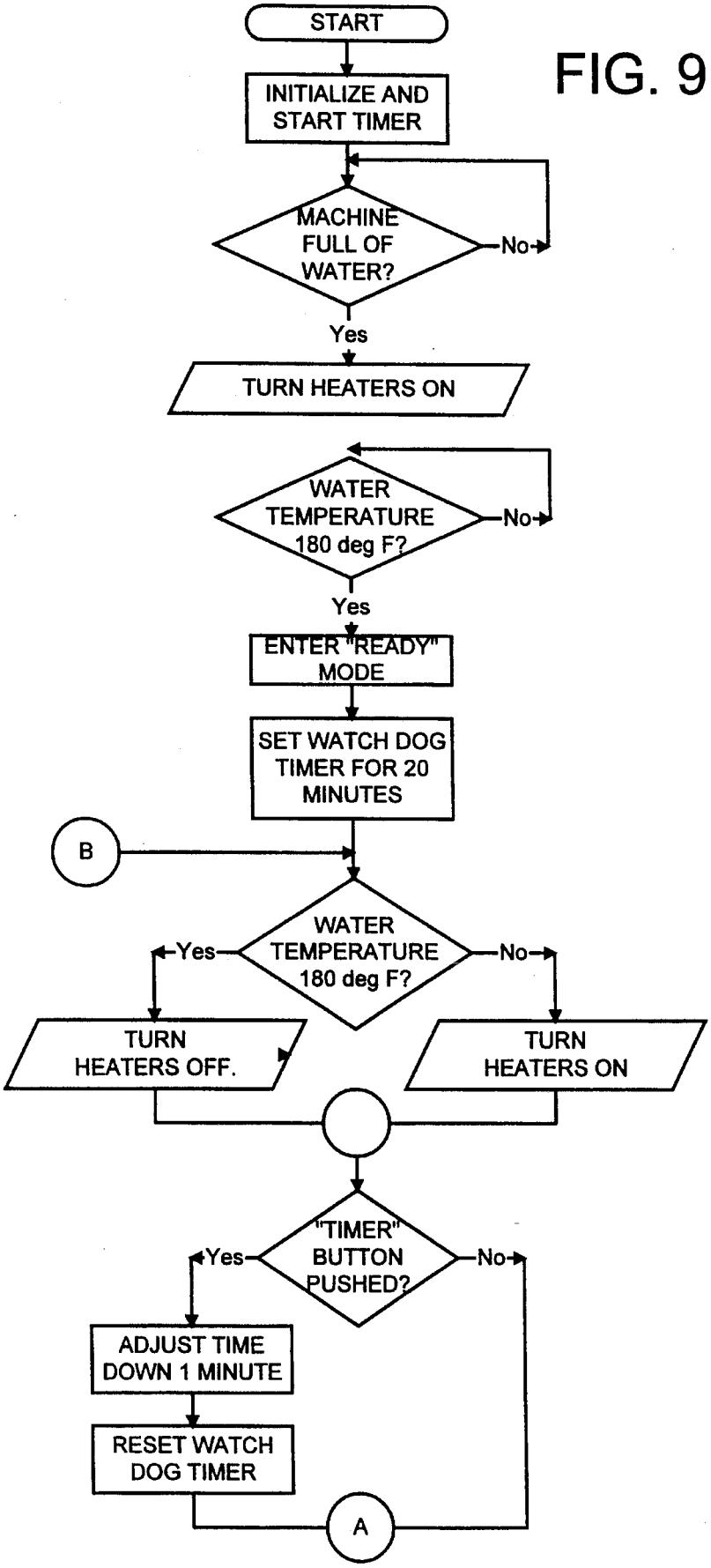
FIG. 9 is a flowchart showing initialization and ready cycles of an automated operating method for the steam cabinet.
Figure 10:
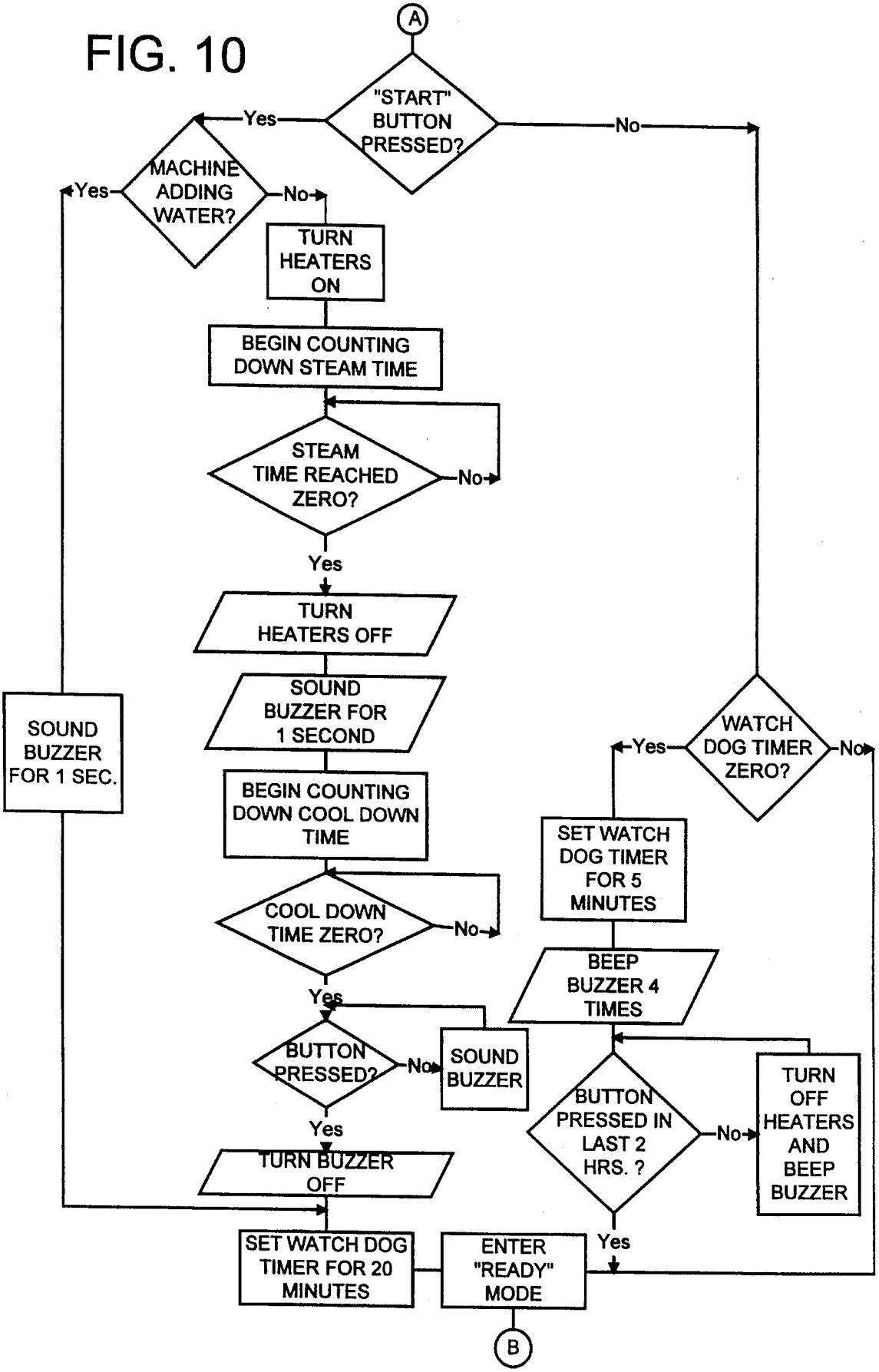
FIG. 10 is a flowchart of a main module of the steam cabinet automated operating method.
Figure 11:
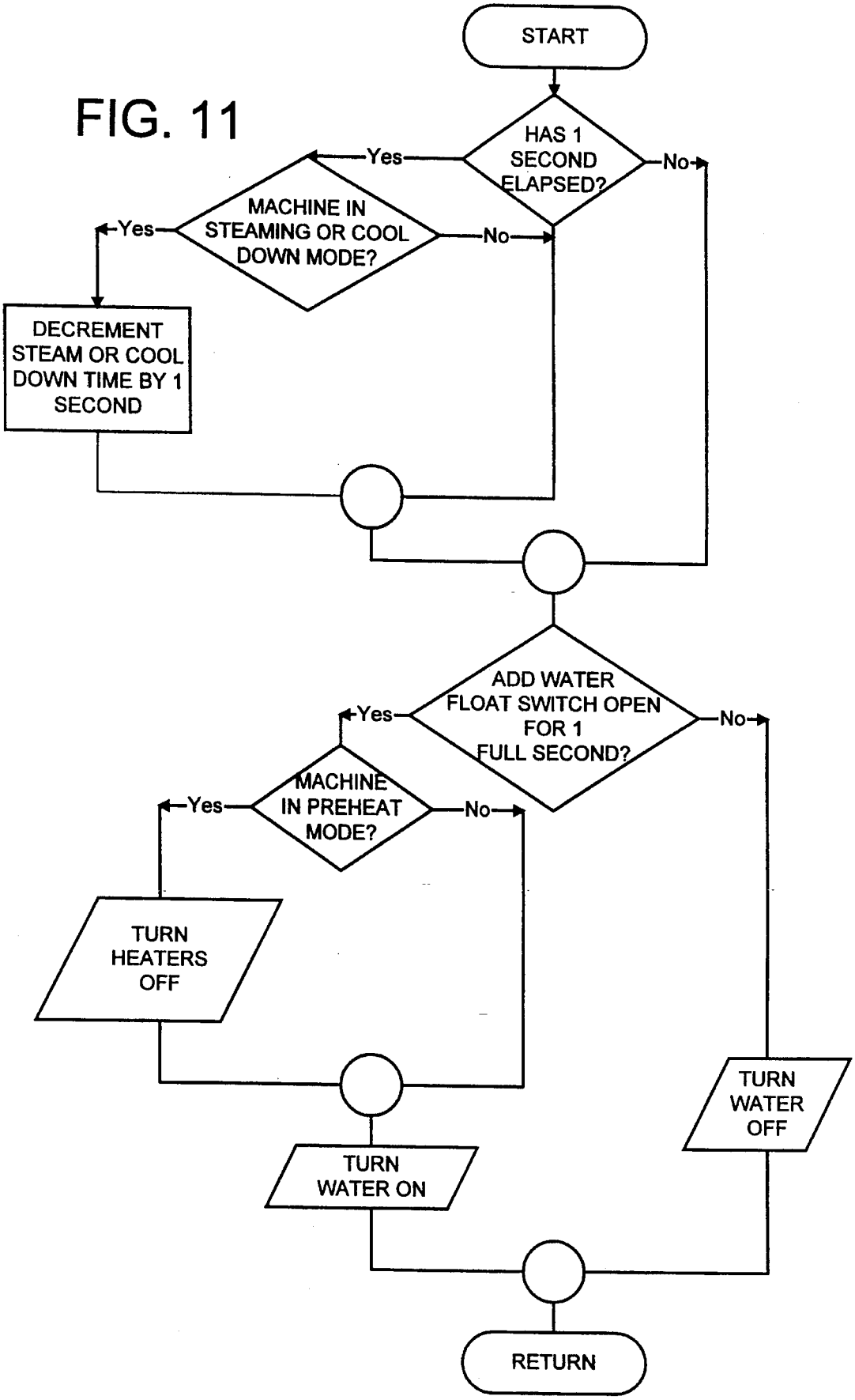
FIG. 11 is a flowchart of a timer interrupt cycle or mode of the automated operating method for the steam cabinet.

The microprocessor 102 is preferably programmable to provide for at least partially automated operation of the steam cabinet 2. FIGS. 9–11 show an example of a method for operating the steam cabinet 2 under automated control by the control system 14.

Upon starting an initialization cycle (FIG. 9), the timer is started and a pre-heat phase is entered by energizing the heater 72, if sufficient water is present in the water pan 44. When the water temperature reaches 180 degrees F the system enters its "ready" mode and the "watch dog" timer is set for twenty minutes. The function of the "watch dog" timer system is to maintain the "ready" mode pending the initialization of a steam cycle. When the "watchdog" runs out of time the unit will beep four times, the "watchdog" then resets to five minutes. Every five minutes for two hours the unit beeps four times and resets. If no buttons have been pressed after two hours the unit beeps continuously.

To initiate a steaming cycle, the steam time is set by decrementing the timer 103 by one minute increments with the timer button 138 from a default setting of, for example, five minutes. When the timer reaches zero, it resets to ten minutes. Thus, the timer can be set for operation in the steaming mode for time periods ranging in one minute increments from one to ten minutes, or other suitable increments and ranges. Upon adjusting the steam cycle time by pressing the timer button, the "watch dog" timer is reset, e.g., to twenty minutes. Pushing the start button 142 thus has the effect of resetting the "watch dog" timer. The control system is thus in its ready mode and is prepared to proceed with the main module of the control sequence as shown in FIG. 10, beginning at "A".

Upon pressing the start button 142, a steam cycle is initiated (FIG. 10) unless the plumbing subassembly 126 is adding water. If water is being added, a buzzer 146 beeps and the "watch dog" timer cycle is reset for twenty minutes and the system enters its ready mode (FIG. 9).

During the steam cycle, the heaters 72 are turned on, steam is generated and the steam cycle time is counted down to zero, whereupon the heater 72 is turned off, a buzzer 146 beeps and a cool down cycle is commenced.

If a button is pressed during the cool down cycle, the "watch dog" timer is reset for twenty minutes and the system enters its "ready" mode. At the end of a cool down cycle, the buzzer 146 is activated four times and the system returns to its "ready" mode of operation. At the end of cool down the buzzer beeps until a button is pressed. However, if no buttons are actuated for a period of two hours, the heater 72 is deactivated and the buzzer 146 beeps continuously to signal that the system is commencing a dormant cycle whereby the water in the pan 44 will be allowed to cool down to ambient temperature.

FIG. 11 shows a timer interrupt module of the control method whereby the timer is decremented by one second intervals during the steaming and cool down cycles. The add water float shift 118*b* is checked, and if it has been open for one second, a fill cycle is initiated. During such a fill cycle, the heaters 72 are turned off if the system is in a preheat mode.

FIG. 11 shows a timer interrupt module whereby the timer is decremented by intervals of, for example, one second each while the system is in a steaming or cool down mode and water is added in response to an open condition of the add water float switch 118*b*. The water valve 122 is opened if the add water float switch 118*b* has been open for more than one second. Open conditions for the float switches 118*a–c* of less than one second can be ignored whereby the control system 14 will only respond to actual conditions requiring a response. Thus, sloshing water in the water pan 44 might briefly activate the float switches 118*a–c*, and misrepresent the steady state condition of the water level in the pan 44 but for the one second delay programmed into the system. When a closed condition of the add water float switch 118*b* is detected, the solenoid 120 closes the water valve 122.

The timer interrupt module (FIG. 11) functions to decrement the steam cycle and cool down cycle times which have been preprogrammed into the control system 14, and to monitor the add water float switch 118*b* and control the water valve 122 in response thereto.

As shown in FIG. 10, when the steam time reaches zero the heaters 72 are turned off, the buzzer 146 is beeped and the system enters a cool down cycle, with the cool down cycle duration being preprogrammed. When the cool down time reaches zero, the buzzer 146 beeps until any button on the control panel 134 is pressed. An operator is thus informed that the steam and cool down cycles have been completed and the garments 4 are ready for removal from the steam cabinet 2. The "watch dog" timer cycle is then reset for twenty minutes and the control system 14 enters its ready mode (FIG. 9).

The steam cabinet 2 is preferably turned off with the main disconnect switch which is combined with the main circuit breaker 108, and the water shut-off valve 128 is closed after all steaming operations are completed. However, in the event these manual shut-off procedures are not performed, the control system 14 will automatically enter a dormant cycle if a button has not been pressed within the proceeding two-hour period, as detected by the "watch dog" timer feature.

The "watch dog" timer feature can be implemented with the microprocessor 102 and the timer 103 and commences a twenty minute countdown at the end of a cooling cycle and then beeps the buzzer 146 four times, and returns the system to a ready mode of operation. The control system 14 will remain in its ready mode of operation for a period of two hours, with the "watch dog" timer operating in continuous five minute intervals. At the end of each such five minute interval the "watch dog" timer, upon reaching zero, causes the buzzer to beep four times. At the end of the two hour period, if no button on the control panel 34 has been pressed, the control system 14 turns off the heaters 72 and beeps the buzzer 146 to signal that the cabinet 2 is entering a dormant mode.

It is to be understood that while certain forms of the present invention have been illustrated and described herein, it is not to be limited to the specific forms or arrangement of parts described and shown.

What is claimed and desired to be secured by Letters Patent is as follows:

1. A steam cabinet, which includes:

(a) a base assembly including water pan means and heater means thermally connected to said water pan means in a heat-exchange relationship therewith;

(b) a cabinet assembly including a front wall with a door opening, a door mounted on said front wall and movable between open and closed positions with respect to said door opening, a pair of opposed side walls, a back wall and a roof mounted on said walls; said cabinet assembly being mounted on said base assembly;

(c) water supply means including water valve means for selectively communicating said water pan means with a water source in an open position thereof, said water valve means having a closed position disconnecting said water supply source from said water pan means; and (d) a control system including limit switch means for maintaining a predetermined water level in said water pan means, said limit switch means being connected to said water valve means;

(e) a low water limit switch with float means positioned in said water pan and adapted to deenergize said heater means in response to a low water condition; and (f) a high water switch with float means positioned in said water pan and connected to said water valve for closing same in response to a high water condition.

2. The steam cabinet of claim 1 wherein said control system includes:

(a) a microprocessor; and (b) an add water float switch including float means positioned within said water pan, said add water float switch being connected to said microprocessor and said microprocessor being connected to said water valve means for opening same in response to a low water condition in said pan.

3. The steam cabinet of claim 1, which includes:

(a) said water pan having a bottom; and (b) said heater means comprising an electrical resistance heater mounted on said water pan bottom.

4. The steam cabinet of claim 3 wherein:

(a) said heater means includes multiple said electrical resistance heaters mounted on said water pan bottom.

5. The steam cabinet of claim 1, which includes:

(a) a garment hanging rod having opposite ends; and (b) said cabinet assembly sidewalls having means for mounting said hanging rod thereon.

6. The steam cabinet of claim 5, which includes:

(a) said hanging rod having an inverted T-shaped configuration and a plurality of spaced notches each adapted for receiving a respective garment hanger hook.

7. The steam cabinet of claim 6 wherein said hanging rod connection means comprises a plurality of vertically-spaced notches formed in each cabinet assembly sidewall, each said notch being adapted to receive a respective hanging rod end.

8. The steam cabinet of claim 1 wherein said door comprises a sliding door slidable between its open and closed positions.

9. The steam cabinet of claim 1 wherein said control system includes:

(a) means for placing said steam cabinet in a ready mode of operation by energizing said heaters and elevating the temperature of the water in the water pan to a predetermined temperature.

10. The steam cabinet of claim 9, wherein said control system includes means for signalling the end of a predetermined ready mode period.

11. The steam cabinet of claim 1 wherein said control system includes means for deenergizing said heaters in response to a predetermined period of non-use of said steam cabinet.

12. The steam cabinet of claim 1 wherein said control system includes input means for inputting a predetermined steam cycle period.

13. The steam cabinet of claim 1 wherein said control system includes means for deenergizing said heater means in response to a low water condition.

14. A steam cabinet for garments on hangers, which comprises:

(a) a base assembly including:
- (1) a base frame having an upper flange;
- (2) a water pan having a generally flat bottom and an upper drip flange, said drip flange sloping downwardly and inwardly;
- (3) said pan being mounted on said frame with said water pan drip flange mounted on said base frame flange;
- (4) said water pan having inlet and outlet openings;
- (5) a plurality of weld studs mounted on said water pan bottom; and
- (6) a heater subassembly including a plurality of channels mounted on said water pan bottom with said weld studs, each said channel receiving an electrical resistance heater, and a pair of electrical power buses mounted on said channels and electrically connected to said heaters;

(b) a cabinet assembly including:
- (1) a front wall having a door opening and a control panel opening;
- (2) a sliding glass door mounted in said door opening and movable between open and closed positions;
- (3) a pair of sidewalls each having a plurality of vertically spaced hanging rod pockets open inwardly to an interior of said cabinet assembly;
- (4) a back wall;
- (5) a roof mounted on top of said walls;
- (6) a hanging rod having an inverted T-shaped cross-sectional configuration and opposite ends, each said hanging rod end being receivable in a respective hanging rod pocket, said hanging rod having a plurality of horizontally spaced notches each adapted for receiving the hook of a respective garment hanger;
- (7) a control panel mounting subassembly including a control wiring cover mounted over said control panel opening in said front wall, a control panel bracket mounted on said front wall in proximity to said front wall control panel opening and an upper face plate mounted on said front wall over said control panel bracket; and
- (8) said cabinet assembly walls being mounted on top of said base assembly;

(c) a plumbing subsystem including:
- (1) a water line connected to a water source and selectively connected to said water pan inlet;
- (2) a shut-off valve mounted in said water line;
- (3) a solenoid-activated water valve mounted in said water line downstream of said shut-off water valve; and
- (4) a petcock valve mounted on said water pan in communication with said outlet; and (d) a control system including:
- (1) electrical power connection means for connection to an electrical power source;
- (2) a circuit breaker connected to said electrical power connection means and having open and closed positions;
- (3) an overheat thermostat connected to said electrical power circuit means and having open and closed positions;
- (4) an electrical contactor connected to said electrical power connection means and having open and closed positions;
- (5) a low water float switch mounted in said water pan;
- (6) an add water float switch mounted in said water pan;
- (7) a high water float switch mounted in said water pan;
- (8) timer means;
- (9) initialization means for initializing and starting said timer means, energizing said heaters in response to a predetermined water level, and initializing a ready mode timer for a predetermined time interval;
- (10) ready mode means for maintaining the water temperature in the water pan at a predetermined level and decrementing the timer means for the ready mode;
- (11) steam cycle means for energizing said heaters and decrementing a steam cycle timer;
- (12) cool down cycle means for deenergizing said heaters and decrementing a cool down cycle timer;
- (13) dormant mode means including said timer means for timing respective time periods since a steam cycle procedure and for deenergizing said heaters;
- (14) a solenoid coupled to said solenoid-activated water valve;
- (15) timer interrupt means for decrementing said steam cycle and cool down cycle timer means and for controlling the water level in said water pan in response to a condition of said add water float switch;
- (16) delay means for delaying a response to a condition of said add water float switch for a predetermined interval;
- (17) temperature sensor means for sensing a temperature of water in said water pan;
- (18) a programmable microprocessor including said timer means and coupled to said float switches and said temperature sensor means for receiving inputs therefrom; and
- (19) a control panel for indicating the operating condition of said control system and for inputing time intervals for said steam cycle.

15. A method of steaming garments, which includes the steps of:

(a) providing a base assembly with a water pan;

(b) providing a cabinet assembly with front, back and opposite sidewalls and a roof mounted on top of said walls;

(c) mounting said cabinet assembly on said base assembly;

(d) providing a door opening in said front wall and providing a door movable between open and closed positions with respect to said door opening;

(e) filling said water pan with water to a predetermined level;

(f) heating said water in said water pan to a predetermined temperature corresponding to a ready mode;

(g) commencing a steam cycle;

(h) elevating the temperature of said water in said water pan and generating steam therewith;

(i) generating steam with said water in said water pan;

(j) deenergizing said heaters;

(k) cooling said water in said water pan; and (l) returning said steam cabinet to a ready mode.

16. The method of claim 15, which includes the additional step of:

(a) preprogramming a microprocessor with a default steam cycle time period.

17. The method of claim 16, which includes the additional step of:

(a) audibly signaling the end of said steam cycle.

18. A steam cabinet, which includes:

(a) a base assembly including water pan means and heater means thermally connected to said water pan means in a heat-exchange relationship therewith;

(b) a cabinet assembly including a front wall with a door opening, a door mounted on said front wall and movable between open and closed positions with respect to said door opening, a pair of opposed side walls, a back wall and a roof mounted on said walls; said cabinet assembly being mounted on said base assembly;

(c) water supply means including water valve means for selectively communicating said water pan means with a water source in an open position thereof, said water valve means having a closed position disconnecting said water supply source from said water pan means; and (d) a control system including limit switch means for maintaining a predetermined water level in said water pan means, said limit switch means being connected to said water valve means;

(e) a control system includes input means for inputting a predetermined steam cycle period; and (f) a control system includes means for storing a predetermined cool down time period and means for signaling the end thereof.

19. The steam cabinet of claim 18 wherein said control system includes a timer interrupt module for decrementing the time periods during said steam cycle and said cool down cycle.

20. The steam cabinet of claim 19 wherein said timer interrupt mode includes means for opening said water valve in response to an add water float switch open condition.

21. A steam cabinet, which includes:

(a) a base assembly including water pan means and heater means thermally connected to said water pan means in a heat-exchange relationship therewith;

(b) a cabinet assembly including a front wall with a door opening, a door mounted on said front wall and movable between open and closed positions with respect to said door opening, a pair of opposed side walls, a back wall and a roof mounted on said walls; said cabinet assembly being mounted on said base assembly;

(c) water supply means including water valve means for selectively communicating said water pan means with a water source in an open position thereof, said water valve means having a closed position disconnecting said water supply source from said water pan means; and (d) a control system including limit switch means for maintaining a predetermined water level in said water pan means, said limit switch means being connected to said water valve means;

(e) means for placing said steam cabinet in a ready mode of operation by energizing said heaters and elevating the temperature of the water in the water pan to a predetermined temperature; and (f) a control system includes means for placing said steam cabinet in its ready mode a predetermined time period after the conclusion of said cool down period.

22. A steam cabinet, which includes:

(a) a base assembly including water pan means and heater means thermally connected to said water pan means in a heat-exchange relationship therewith;

(b) a cabinet assembly including a front wall with a door opening, a door mounted on said front wall and movable between open and closed positions with respect to said door opening, a pair of opposed side walls, a back wall and a roof mounted on said walls; said cabinet assembly being mounted on said base assembly;

(c) water supply means including water valve means for selectively communicating said water pan means with a water source in an open position thereof, said water valve means having a closed position disconnecting said water supply source from said water pan means; and (d) a control system including limit switch means for maintaining a predetermined water level in said water pan means, said limit switch means being connected to said water valve means;

(e) a microprocessor;

(f) an add water float switch including float means positioned within said water pan, said add water float switch being connected to said microprocessor and said microprocessor being connected to said water valve means for opening same in response to a low water condition in said pan; and (g) a control system includes means for delaying a reaction to an add water float switch open condition for a predetermined time period.

23. A steam cabinet, which includes:

(a) a base assembly including water pan means and heater means thermally connected to said water pan means in a heat-exchange relationship therewith;

(b) a cabinet assembly including a front wall with a door opening, a door mounted on said front wall and movable between open and closed positions with respect to said door opening, a pair of opposed side walls, a back wall and a roof mounted on said walls; said cabinet assembly being mounted on said base assembly;

(c) water supply means including water valve means for selectively communicating said water pan means with a water source in an open position thereof, said water valve means having a closed position disconnecting said water supply source from said water pan means; and (d) a control system including limit switch means for maintaining a predetermined water level in said water pan means, said limit switch means being connected to said water valve means; and (e) a control system includes means for storing a preprogrammed steam cycle duration as a default and means for revising same.

* * * * *